United States Patent [19]

Haydu

[11] Patent Number: 4,757,813

[45] Date of Patent: Jul. 19, 1988

[54] EMERGENCY EXIT MASK SYSTEM

[76] Inventor: Bartley A. Haydu, 4706 Beechmont Dr., Anderson, Ind. 46011

[21] Appl. No.: 78,554

[22] Filed: Jul. 28, 1987

[51] Int. Cl.[4] ..... A62B 18/00

[52] U.S. Cl. ..... 128/201.26; 128/201.23

[58] Field of Search ..... 128/201.23, 201.26, 128/205.17

[56] References Cited

U.S. PATENT DOCUMENTS

| | | | |
|---|---|---|---|
| 667,481 | 2/1901 | Wood | 128/201.26 |
| 728,476 | 5/1903 | Langer | 128/201.26 |
| 1,090,936 | 3/1914 | Morgan | 128/201.26 |
| 3,521,629 | 7/1970 | Reynolds | 128/201.23 |
| 3,762,407 | 10/1973 | Shonero | 128/201.23 |
| 4,614,186 | 9/1986 | John | 128/201.26 X |
| 4,710,756 | 12/1987 | Thornburg et al. | 128/201.23 X |

*Primary Examiner*—Gerald A. Michalsky

*Attorney, Agent, or Firm*—Woodard, Emhardt, Naughton, Moriarty & McNett

[57] ABSTRACT

An emergency exit respiratory mask device comprises a rebreathing bag, a face mask, and a head-covering cap, all formed of a single sheet of flexible transparent plastic. The sheet is folded upon itself and sealed along selected margins thereof to determine the boundaries of the bag, a filling and emptying passageway to the bag, and the cap. A mouthpiece is provided at the distal end of the passageway. A whistle is provided in the mouthpiece. An inflating spring is employed in the bag. Printed instructions are provided inside the bag and are readable through the bag material.

27 Claims, 9 Drawing Sheets

EMERGENCY EXIT MASK SYSTEM

This invention relates generally to respiratory apparatus, and more particularly to a rebreathing mask system for use during emergency exit from a smoke-filled area.

BACKGROUND OF THE INVENTION

It is known that most building fire related deaths occur as a result of smoke inhalation. Although smoke detecting alarms are very helpful, particularly to awaken persons sleeping in areas which are becoming smoky, there remains the task of getting through smoky areas to exit doors. Procedures have been described to help in doing so, and typically involve wetting towels, breathing through them, and the like. Such procedures involve several steps at the time of need, and for which there might not be time or available water pressure. The present invention is addressed to the need of a person who must quickly exit through a smoke-filled and toxic gas-filled areas.

SUMMARY OF THE INVENTION

Described briefly, according to a typical embodiment of the present invention, a respiratory mask is erected from a single transparent sheet of plastic which has been folded and sealed to provide a rebreathing bag with a passageway to a mouthpiece, the sheet being shaped and perforated to provide a cap-forming portion with face covering, to which a nose clip is mounted. The prospective user inflates the bag by blowing into the mouthpiece, and then shuts the passageway from the mouthpiece to the bag, whereupon the bag will remain inflated and ready for use in the event of an emergency. In a preferred embodiment, an inflation aiding spring is employed internally of the bag so it will automatically fill itself with air when just opened up from its packaging. Additional filling is at the discretion of the user.

DESCRIPTION OF THE PREFERRED EMBODIMENT

Figure 1:
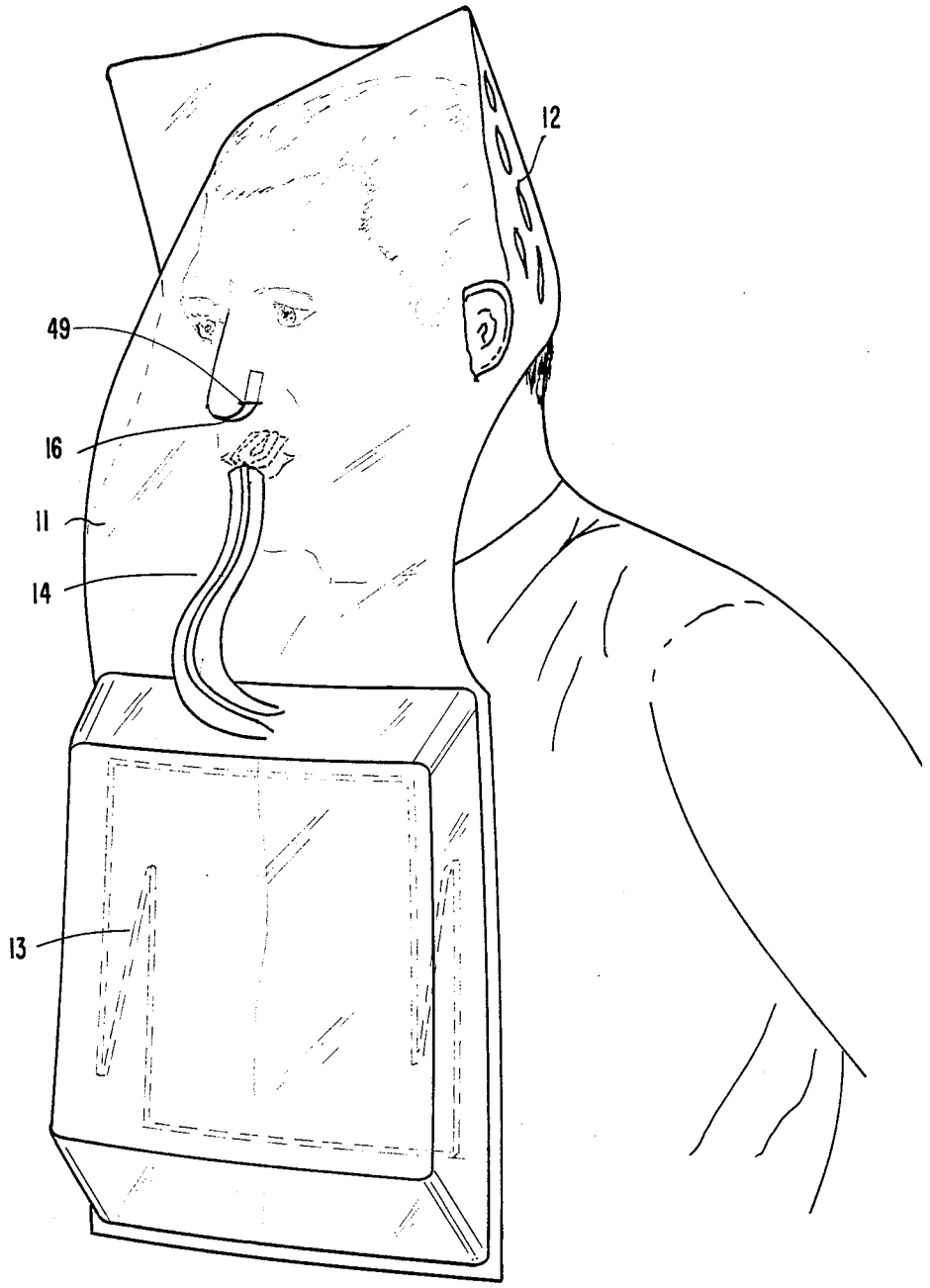
FIG. 1 is a pictorial view of a respiratory mask in use according to my invention.

Referring now to the drawings in detail, and particularly to FIG. 1, an individual is shown wearing the mask device of the present invention which is typically made of a single sheet of plastic which is transparent so the individual can see through the face mask portion 11. It also includes a cap portion 12, rebreathing bag portion 13, and breathing tube portion 14. A nose clip 16 is mounted through from the outside to the inside through two holes to the underside of the nose to assure that breathing will be done through the mouth when the device is in use.

Figure 2:
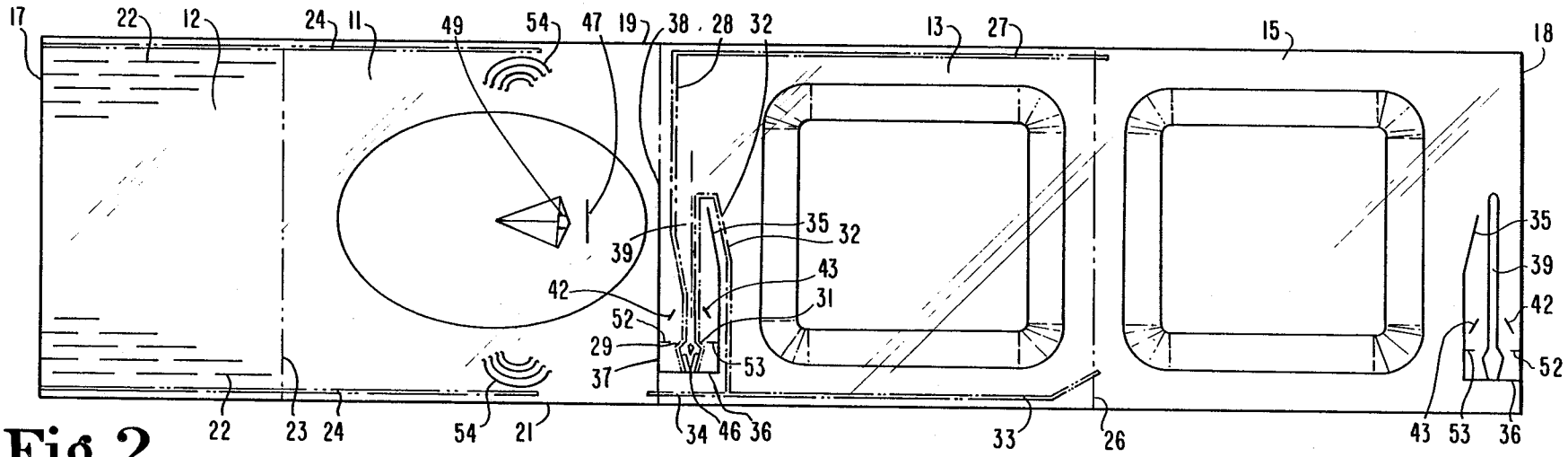
FIG. 2 is a plan view of the plastic sheet prior to formation into the mask.

Referring now to FIG. 2, the preferred embodiment of the present invention is made of a single sheet of plastic which is illustrated in strip form in FIG. 2 extending from one end 17 to the other end 18. A typical length between these ends is 50 inches. The width of the strip from side edge 19 to edge 21 is typically 12 ½ inches. In this way, the devices can be made from a 50 inch wide roll of transparent plastic film, this being a conventional currently-available width of N.F.G.-butyrate transparent sheet as produced by Flex-0-Glass, Inc., 1100 North Cicero Avenue, Chicago, Ill. 60651. The material would be cut every 12.5 inches to produce blanks of the overall shape as shown in FIG. 2 herein.

Referring to the blank itself, the blank may be conveniently considered as comprising first, second, third and fourth portions, 12, 11, 13 and 15, respectively. Slits are provided at various locations and for reasons which will be described hereinafter. While these slits, such as 22 in portion 12 for example, may be made as the blanks are cut from the roll material, it may be more convenient to cut some of them after some material folding steps are taken in development of the mask device from the blank as described hereinafter.

Figure 3:
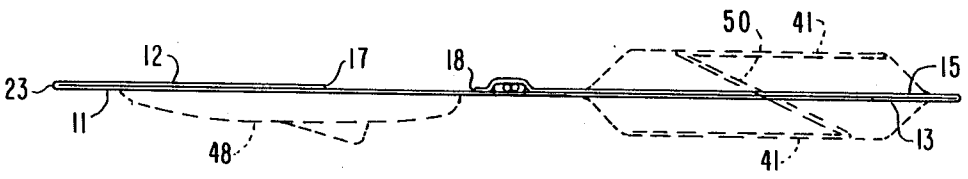
FIG. 3 is an edge view of the sheet at one stage in the development of the mask.

In development of the device, portion 12 is folded over on top of portion 11 at fold line 23 and is heat sealed to portion 11 at spaced points along lines 24 near the opposite side margins of the strip. The edge 17 is not sealed to portion 11. Similarly, portion 15 is folded over onto portion 13 at the fold line 26. When portion 15 is in position overlying portion 13, it is continuously heat sealed to portion 13 along lines 27, 28, 29, 31, 32, 33 and 34. The device is then in the condition shown by solid lines in FIG. 3. The sealed combination of portions 13 and 15 can then be slitted at lines 35, 36 and 37 up to point 38, to thereby distinguish a breathing tube portion. The portions 13 and 15 are preferably heat deformed at the location between seal lines 29 and 31 on portion 13 and at the corresponding locations on portion 15, to provide grooves in the respective portions 13 and 15. These grooves cooperate, when portions 13 and 15 are heat sealed together along the lines 29 and 31 from point 38 to the slit 36, to provide a preformed tube 39 which communicates from the slit edge 36 into the chamber area bounded by seal joint lines 28, 27, fold line 26, and seal joint lines 33 and 32. Tube 39 becomes a breathing tube communicating with a chamber which, when inflated, may assume the configuration shown by the dotted lines 41 in FIG. 3. The numerals 35, 36 and 39 are shown in two places on FIG. 2 to show the relationship of these features in the blank and which are in registry when portion 15 is folded over into overlying and sealed relationship with portion 13. The slits along the lines 35, 36 and 37 enable lifting or pushing the breathing tube portion out of the plane of the sheet portion 13 to a position such as shown in FIG. 1.

Some additional slits are provided in the sheet at locations 42 and 43. These also may be placed in the sheet after the folding and sealing has been done. Although the sealing of the sheets along the lines 29 and 31 defines a passageway from the chamber 41, there is no seal between these lines at the edge 46. This enables insertion of a V-shaped tube device (FIG. 7) through that edge (which is the distal end of the breathing tube portion) between the sheets to provide a mouthpiece communicating with the passageway 39 as the user breathes into and out of the chamber 41.

Figure 5:
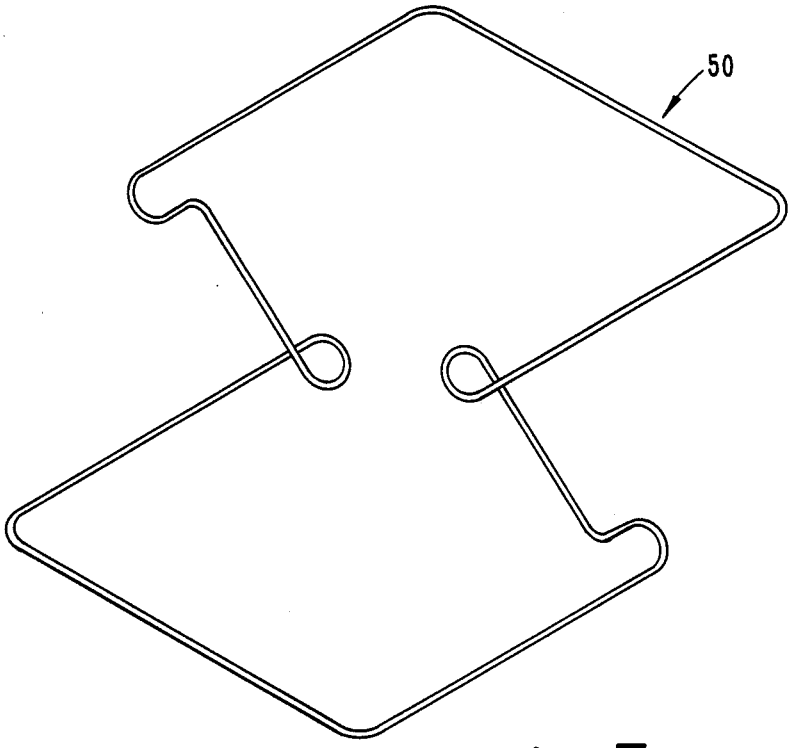
FIG. 5 is a pictorial view of an inflation assist spring.
Figure 6:
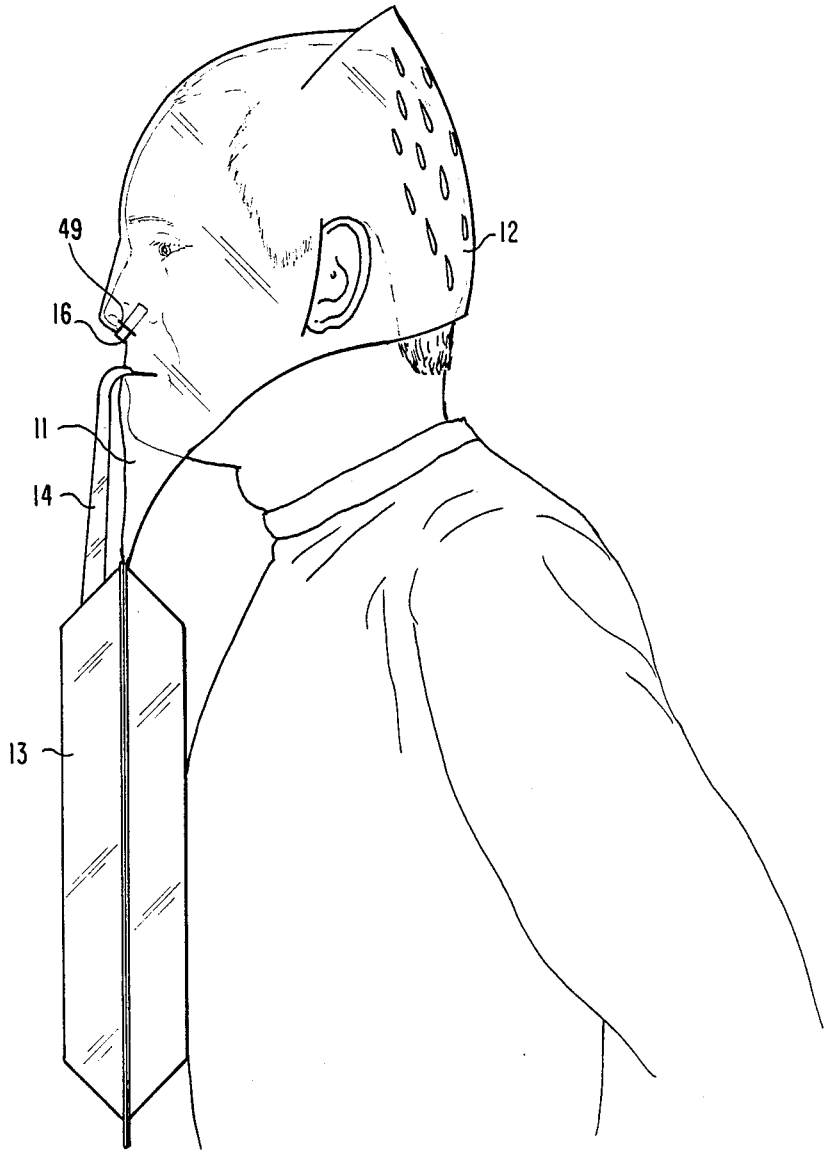
FIG. 6 is a side view of the mask in use.

An additional slit 47 is provided in the face portion of the mask to receive the breathing tube through it and position the mouthpiece at the mouth of the user as shown in FIGS. 1 and 6. If desired, the face portion 11 can be heat deformed at the area shown by the dotted line 48 in FIGS. 1 and 3 to more perfectly accommodate facial features, particularly the nose. Slits 49 can receive through them and retain the nose clip 16 (FIG. 1). A spring 50 such as shown in FIG. 5 and dotted in FIG. 3 may be installed between the portions 13 and 15 of the sheet when portion 15 is folded over portion 13 for sealing, and tends to urge the sheets apart to establish the chamber 41 shown in FIG. 3. This spring aids in filling the chamber for a purpose which will soon be described herein. The spring may be made of 0.045–0.059 inch diameter spring wire, music wire, or stainless wire, for example, formed as shown in the unstressed state in FIG. 5 (where the wire thickness is exaggerated for clarity of illustration).

Figure 7:
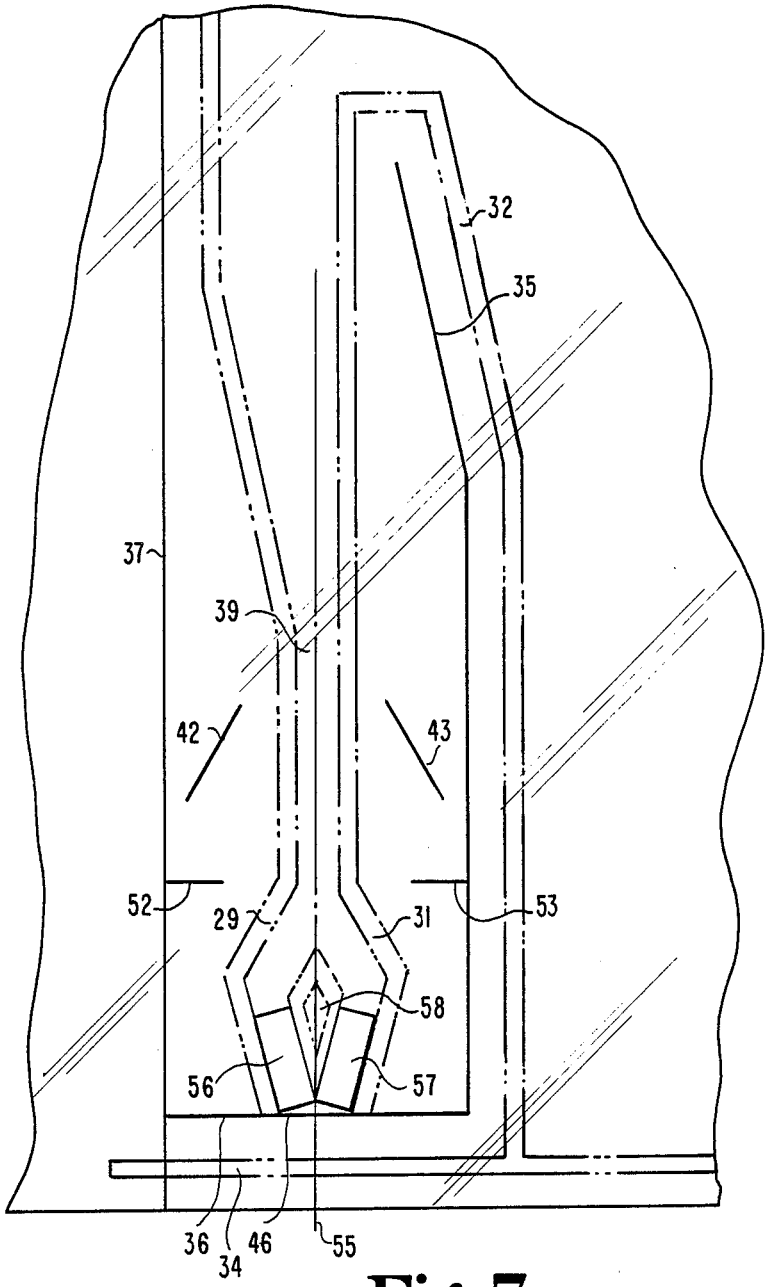
FIG. 7 is an enlarged fragmentary view of the mouthpiece and breather tube portion of FIG. 2.

FIG. 7 shows details of the mouthpiece at the distal end of the breathing tube portion of the device. There is an "island" in the breathing tube and which is formed by heat sealing the portions 13 and 15 together at the location 58. This divides the breathing tube at this location into two passages. A plastic tube such as a conventional drinking straw (and will hereafter be referred to as a "straw") is transversely cut almost through, and is formed into a "V" shape, with branches 56 and 57 pushed into the two passages of the breathing tube. The island 58 co-operates with the walls of the breathing tube to tightly engage the outside diameter of the straw branches to hold the straw in place so that it won't come out of the breathing tube passages. If desired, the straw can be heat sealed or otherwise sealed to the portions 13 and 15 to provide added assurance that it will stay in place, once installed. This straw is preferably installed after the breathing tube end has been pushed through the slit 47 mentioned above. The two edge slits 52 and 53 in the breathing tube portion can engage the mask portion 11 at the ends of the slit 47, to lock and locate the breathing tube portion in the mask portion 11. The length of the slit 47 between its ends is only long enough to firmly retain the mouthpiece in place, locking at the depth of the two edge slits 52 and 53. This mouthpiece will be assembled through the slit 47 just before the device is packaged for shipment from the manufacturer, by pulling the distal end 46 of the breathing tube out from the sandwiched sheets 15 and 13 in the direction of arrow 51 (FIG. 4), and turning it around the end in the direction of the arrow 51A, and pushing the mouthpiece down through the slot 47 in portion 11.

Figure 4:
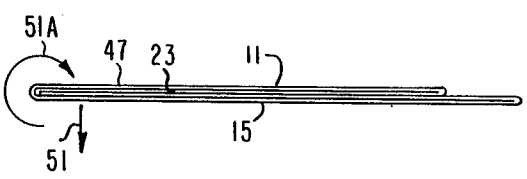
FIG. 4 is an edge view of the mask when folded flat for packaging.

The mask of the present invention may be marketed individually or in packages containing several masks per package. They will normally be packed flat as shown in FIG. 4. To the extent that the face portion and breathing tube are preformed, and the preformed portions are not flattened during packaging, they may not be entirely flat. Instructions for use may be provided on a sheet of paper in the chamber 41 where the instructions can be viewed readily through the transparent plastic sheet. The instruction sheet can remain in that chamber, as it will cause no harm when the device is being used.

Figure 9:
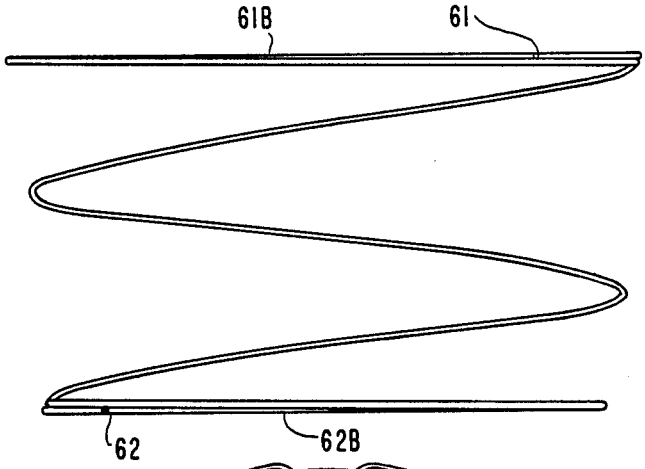
FIG. 9 is an elevational view thereof, fully extended.
Figure 8:
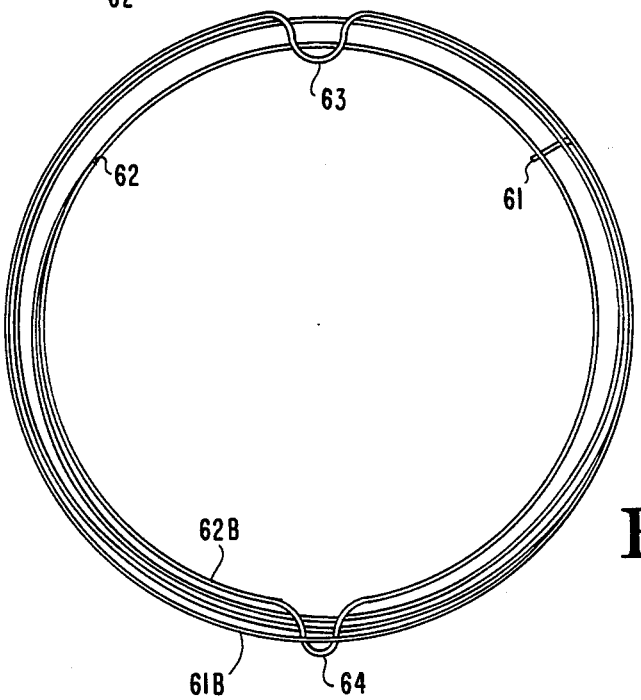
FIG. 8 is a plan view of an alternate (coil) form of inflation assist spring, in a flattened state.

FIGS. 8 and 9 show a coil form of inflation assist spring. This spring may be made of 0.050–0.062 inch diameter spring wire, music wire, or stainless steel wire, for example. It is a continuous coil beginning at end 61 and continuing to make the first turn 61B about 9.00 inch diameter, and then extending in a spiral to the last turn of about 8.00 inch diameter to the end 62 of the last turn 62B. The first turn has an inwardly directed formed notch 63 extending inboard of the axially projected circle of the last turn. Similarly, the last turn has an outwardly directed formed notch 64 extending outboard of the axially projected circle of the first turn. The overall height of the fully extended spring is about 5.00 inches. The arrangement of the notches in the first and last turns in diametrically opposite position, and overlapping the axial projection of the opposite end turn, enables "latching" the spring in the collapsed condition by hooking the notch 63 in front of the last turn, and hooking the notch 64 behind the first turn. This can be done before the spring is placed on the blank portion 13 (FIG. 2) so that it will remain flat when the portion 15 is folded over portion 13 for the heat sealing step. After the sealing is done, the spring can remain flat during the packaging of the mask device for shipment.

In use of the device, the user removes it from the package and unfolds the device. In the embodiment incorporating the inflation assist spring, and if the spring (either FIG. 5 or FIG. 8 version) remains latched flat, it is easy to manipulate the bag 41 to unlatch the spring. Then the spring will begin to expand the chamber 41 as soon as the device is unfolded and the mouthpiece is exposed to the admission of room air. The chamber will thereby automatically inflate to approximately 85% of capacity, and remain so inflated with room air. Then the device can be stored at the side of or, preferably, on the floor under a bed where it can be readily reached by a person lying in bed.

Then, if a smoke alarm or other alarm sounds necessitating exit through a smoky room, the person may slide from the bed onto the floor where smoke is usually least dense or absent. The person then opens up the mask and puts the head cap portion on the head, the nose clip on the nose, and breathes in and out of the rebreathing bag 41. This can be continued while crawling along a floor to an exit. Eventually, of course, the amount of oxygen available in the rebreathing bag will be decreased to the point where it is no longer adequate to sustain life. However, in correct usage, that should not occur until at least four to seven minutes after the beginning of use of the mask. This should be more than sufficient time for a person to reach an exit.

In addition to providing air to sustain life during an emergency exit, the mask provides some protection of the eyes from smoke. The nose clamp facilitates breathing through the mouth as is required in the correct use of this invention. If desired, the device can be reused. However, it is inexpensive enough that it can be considered an expendable item.

The spring is intended to enhance the filling function, as it is possible to fill the chamber to 85% of capacity as the spring expands itself. The spring force should be adequate to fill the bag to 85% capacity by itself in fifteen seconds or less. The full 100% capacity is obtainable by blowing air into the mouthpiece. If it is desired to take the mask device upon departure from a hotel or the like, in the event that it was not necessary to use the mask, the chamber 41 can be collapsed, and the unit folded up as shown in FIG. 4 and placed in or returned to the original traveling bag.

If the device is manufactured without an inflation assist spring, the user must inflate it to prepare it for emergency use. To do so, after taking the device out of the package or traveling bag, and unfolding it, the user blows into the mouthpiece at end 46 to inflate the chamber 41, there being no outlet from that chamber except through the breathing tube 39. When the chamber has been completely filled, the user can then fold or roll-up the distal end of the breathing tube and clamp it with a nose clamp. As an alternative to the use of a clamp (nose clamp or otherwise) to shut off tube 39, the user can remove the tubes 56, 57 and, beginning at the end 46, fold up the tube and insert the ends of the folded-up distal end through the slits 42 to keep it folded up. Therefore, the air will not leak from the rebreathing chamber 41. In this case, the edge slits at 52 and 53 (FIG. 2) in the breathing tube portion, which do not extend past the seal lines 29 and 31, facilitate extending the ends of the folded-up portion of the breathing tube through the slits 42 and 43 to keep the breathing tube closed.

In the case of emergency, the procedure is the same as described above, except that the user must unfold the breathing tube and, while holding it shut, insert the mouthpiece into the mouth. Then the user can release the breathing tube, gripping the mouthpiece in the mouth, and begin breathing from and to the rebreathing bag in the same manner as discussed above.

From the foregoing description, it may be seen that the spring equipped version has the benefit of avoiding the necessity of rolling and unrolling the breathing tube. It also has the advantage of encouraging the user to breathe back into the bag, rather than into the atmosphere, as this is essential to avoid premature exhaustion of useful air. If the user has any difficulty inhaling from the bag, against the inflation influence of the spring, this is easily solved by application of slight hand pressure on the spring against the chest, which will force air from the bag into the lungs. The spring feature can tend to slow down the breathing and thereby extend the life of the air in the chamber 41.

Individual preference may suggest keeping a mask under a bed at a residence full time, possibly in a clean paper or plastic bag to keep it clean but without crushing the air chamber. The slots in the head cap portion enable accommodation of various sizes of head. The slits 54 are useful to receive the ears of the user and help hold the cap portion on the head. Whichever one of the illustrated three slits on each side best fits, is the one which would be used.

Referring now to FIGS. 10 through 14, the first, second, third, and fourth portions or panels of the plastic sheet are shown at 66, 67, 68 and 69, respectively. The panel 66 has been folded at line 71 over and onto panel 67 and heat sealed to it along lines 72 and 73 to the edge 74 of panel 66 and which is not heat sealed to panel 67. Panel 66 has been preformed to the "head form" shape shown best at 66H in FIGS. 11 and 12 and schematically outlined at 66H in FIG. 10. Similarly, the panel 67 is provided with a "face form" best shown at 67F in FIGS. 11 and 12, and outlined generally by the dotted line 67F in FIG. 10. That face formed portion is further formed at the "nose form" portion 67N, also best shown in FIGS. 11 and 12 and generally outlined by the dotted line 67N in FIG. 10.

Figure 10:
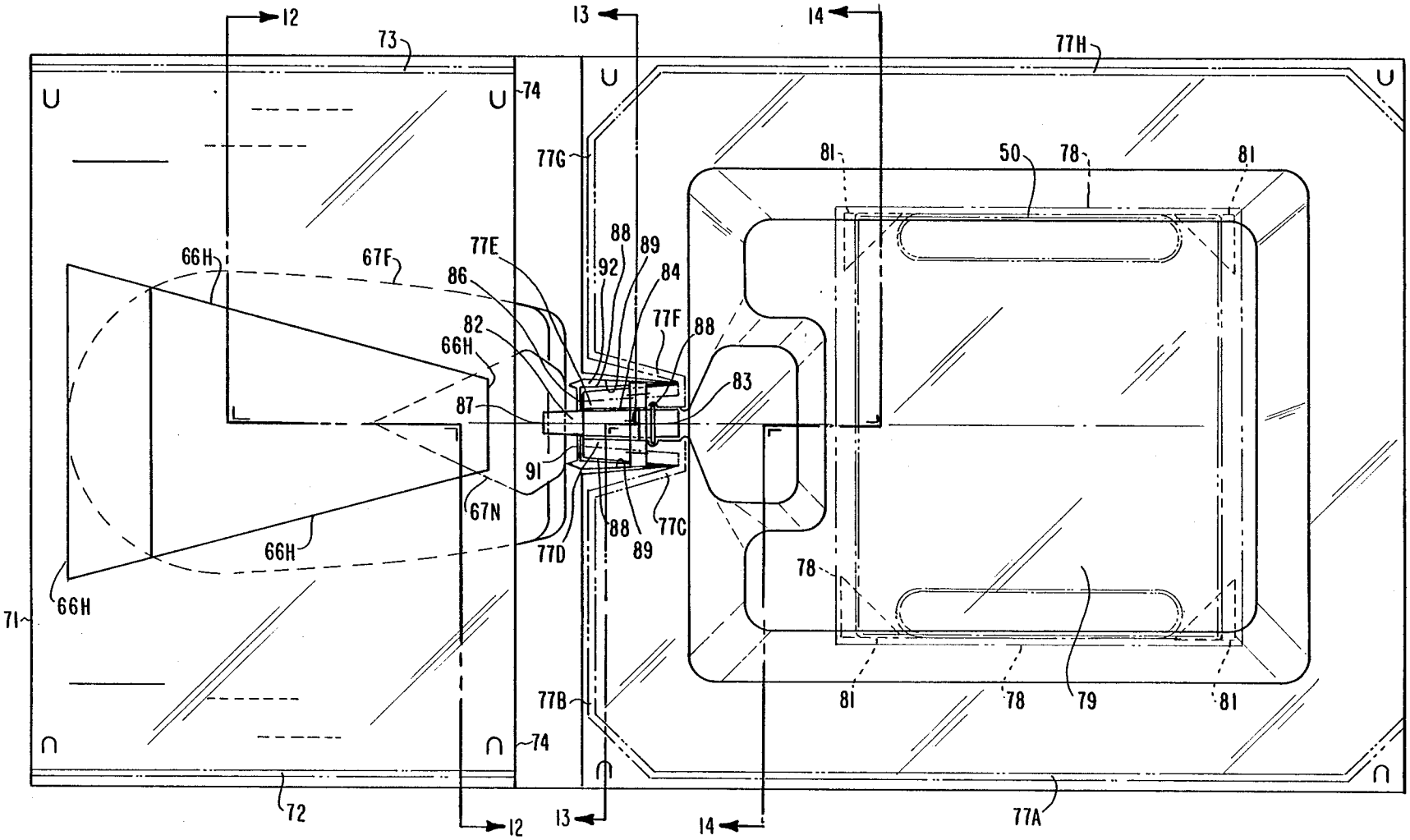
FIG. 10 is a plan view of a most preferred embodiment of the invention at the same stage of development as that shown in FIG. 3 for the first described embodiment.
Figure 11:
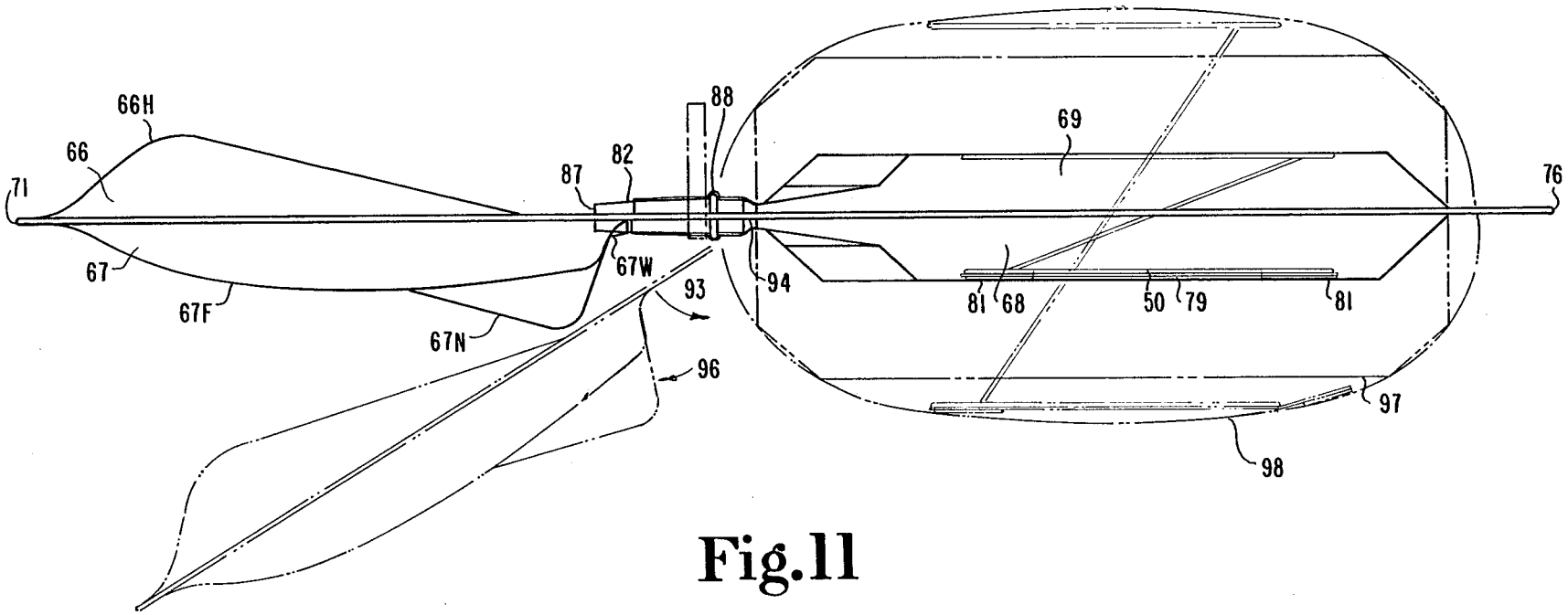
FIG. 11 is an edge view of the embodiment of FIG. 10 at the same stage of development.
Figure 14:
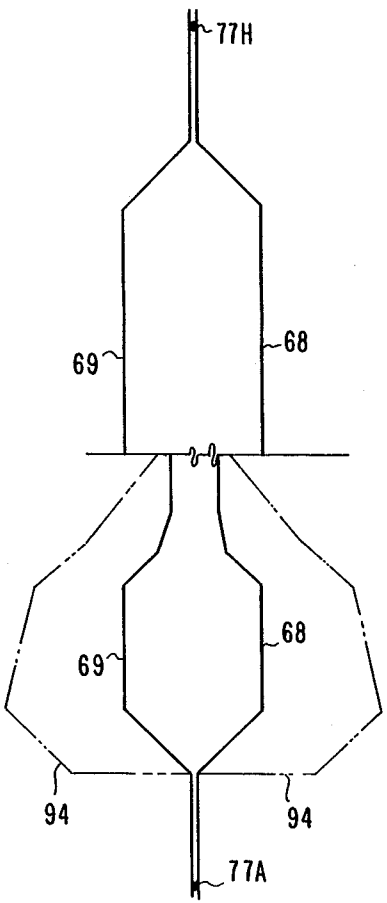
FIG. 14 is a section therethrough taken at line 14—14 in FIG. 10 and viewed in the direction of the arrows.
Figure 13:
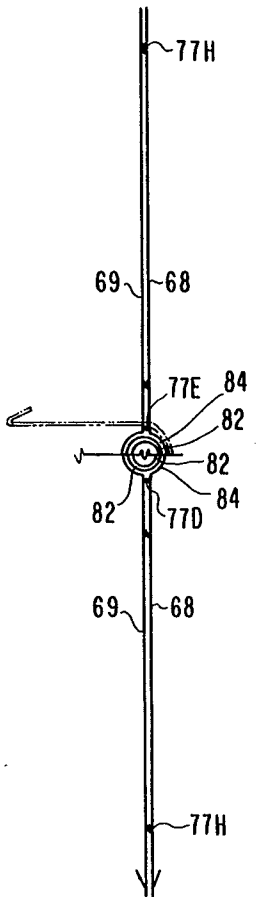
FIG. 13 is a section therethrough taken at line 13—13 in FIG. 10 and viewed in the direction of the arrows.
Figure 12:
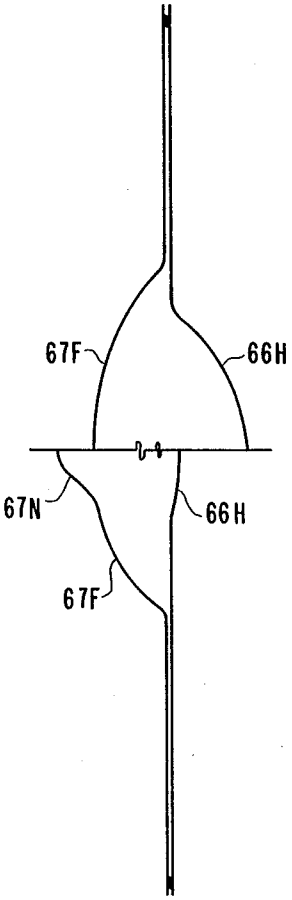
FIG. 12 is a section therethrough taken at line 12—12 in FIG. 10 and viewed in the direction of the arrows.

Panel 69 has been folded over a panel 68 at the fold line 76 into overlying relationship with the panel 68, to which it is heat sealed along the lines 77A through 77H. Each of these panels is pre-formed to receive the spring 50 within an area 78 (FIG. 10). It rests upon an instruction sheet 79 placed within that area and having four pieces 81 of luminous material in triangular shape on the bottom of the sheet at the four corners so it will be visible to the exterior by a rescuer or another fire victim when the mask assembly is worn. The instruction sheet is printed on both sides with instructions for use as described in this specification, but abridged if desired to conserve space on the sheet, the instructions being readable through the transparent bag material.

In this embodiment of the invention, the breathing passageway is formed a bit differently from that of the other embodiment and includes a whistle 82. For this purpose, a whistle marketed by C. A. Reed, Inc. of Williamsport, Pa. 17701, will serve very effectively. It is generally cylindrical in shape and centered on the axis of symmetry 83 of the mask assembly. It is inserted in the passageway 84 provided between the panels 68 and 69 between the heat sealed lines 77D and 77E. It extends through the edge 86 of the panels to the distal end 87 of the whistle. It has a perimetrical flange 88 which, in addition to the snug fitting of the panels around the whistle, secures the whistle in position when the heat sealing is done along the lines 77D and 77E so that it can neither move toward nor away from the rebreathing bag. The whistle sounds off when air is blown into the air chamber. Air can be inhaled from the chamber through the whistle with very little effort. Since the whistle is a relatively rigid structure and is not intended to interfere with movement of the head panels 66 and 67 relative to the rebreathing bag panels 68 and 69, the nose formed portion 67N of the panel 67 is formed at 67W to accommodate the distal end portion of the whistle. Also, portions of the panels 67, 68 and 69 are cut away at lines 86, 88, 89 and 91 to provide a space 92 which accommodates folding the unit in a manner such as at FIG. 4 for the previously described embodiment, although in the direction of arrow 93 in FIG. 11, for packaging. Then, when the mask is to be worn, it may be unfolded about line 94 to any suitable position such as dotted lines 96, for example where, upon pulling the edge 74 of panel 66 away from panel 67, the head portion can be pulled over the head, the nose clamp installed on the nose, and the whistle placed in the mouth for breathing through the whistle into and out of the rebreathing bag. Of course, as soon as the mask has been unfolded from the packaged condition, the spring 50 will have expanded to place the rebreathing bag portion in the approximate configuration of the dotted outline 97 in FIG. 10, which represents approximately 85% of capacity. If it were inflated to 100% of capacity, it would be expanded to approximately the outline of dotted line 98 in FIG. 10.

Because the device of my invention is so simple and inexpensive, it can be readily furnished by a hotel or motel or the like. Also, although one mask of the present invention is not intended to enable a person to use it to save his own life and the lives of others, additional masks can be readily provided and pre-filled with air for the use of other individuals, if desired.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An emergency exit respiratory device comprising:

a unitary member including rebreathing bag, face-mask and head-mount means, all formed of a single sheet of flexible material folded upon itself to place one portion of said material overlying another portion of said material in at least one area of said material, the overlying portion being sealed to the overlaid portion along a first line pattern to define boundaries of the rebreathing bag; and mouthpiece means adapted to reception in the mouth of the user and communicating with the bag to enable the user to breathe to and from the bag.

2. The device of claim 1 and wherein:

said material is transparent whereby the user can see through the face-mask means.

3. The device of claim 1 and wherein:

said head-mount means comprises a further portion of the sheet folded upon itself to establish a second overlying portion cooperating with a second overlaid portion to form a pocket useful as a cap on the user's head.

4. The device of claim 3 and further comprising:

a first set of openings in said sheet to facilitate conformation of the head mount means to the head of the user, and a second set of openings in the sheet to receive therethrough the ears of the user.

5. The device of claim 3 and further comprising:

a nose clip in the mask for reception on the nose of the user.

6. The device of claim 1 and wherein:

said overlying portion is sealed to said overlaid portion along a second line pattern to define therein a filling and emptying passageway between the mouthpiece means and the bag, there being at least one opening through the member adjacent said second line pattern to distinguish the passageway from the bag and thereby enable freedom of movement of said passageway from said bag except for a location of communication of said passageway with the bag at on proximal end of the passageway, to facilitate manipulation of said passageway separately from said bag.

7. The device of claim 1 and further comprising:

a compression spring in the bag and oriented to facilitate expansion of the bag to aid inflation thereof.

8. The device of claim 7 wherein:

said spring includes portions thereof engageable with overlapping portions thereof to hold the spring in a flat, compressed condition until intentionally released to expand.

9. The device of claim 7 wherein said spring is generally rectangular in shape.

10. The device of claim 9 wherein, said spring is generally z-shaped when viewed from the side.

11. The device of claim 1 wherein:

said head-mount means has openings therein to facilitate retention on the head of the user.

12. The device of claim 11 wherein:

said openings are near the side margins of the sheet to receive the ears of the wearer and retain the device on the head.

13. The device of claim 11 wherein:

the material of said sheet is transparent N.F.G. butyrate plastic.

14. The device of claim 1 and wherein:

said overlying portion is sealed to said overlaid portion along a second line pattern to define therein a filling and emptying passageway for communication of the mouthpiece means with the bag, there being at least one opening in the member adjacent said second line pattern to distinguish the passageway and facilitate freedom of movement of at least a portion of said passageway relative to the face mask means of the member.

15. The device of claim 14 and further comprising:

a whistle situated in said passageway to emit a clearly audible sound during passage of air through said passageway between the user and the bag.

16. The device of claim 15 wherein:

said whistle is secured between the overlying and overlaid portions of said member within said second line pattern, and is oriented to sound when air is moving through said passageway in a direction toward said bag.

17. A method making an emergency exit device comprising the steps of:

using a sheet of transparent plastic material and cutting the sheet to make an elongate strip;

folding a first portion of the strip from a first fold near one end of the strip toward the other end so the first portion overlies a second portion;

sealing said first portion to said second portion along margins from the fold line to a region near said one end, and across the region to provide a chamber and a communicating passageway;

cutting the sheet adjacent the margins of the passageway so that the passageway is movable out of the plane of the second portion and adapted to receive a mouthpiece, while communicating from the mouthpiece end of the passageway to the chamber to facilitate filling and emptying the chamber from the mouthpiece;

folding a third portion of the sheet from said other end along a second fold line near said other end toward the one end so the third portion overlies a fourth portion; and sealing side margins of the third portion of the sheet to said fourth portion at locations from the folded end to the other end to thereby form head-covering cap portion of the mask device.

18. The method of claim 17 and further comprising the steps of:

providing openings in the head covering cap portion of the mask device to facilitate shaping over the head of the user.

19. The method of claim 18 and further comprising the steps of:

attaching a nose clip to a portion of the mask device between the passageway and head-covering cap portion.

20. The method of claim 17 and further comprising the steps of:

blowing into the mouthpiece to fill the chamber with air, and then folding the passageway to close the passageway for storage of air in the chamber.

21. The method of claim 20 and further comprising the step of:

assisting the chamber filling step with spring biasing means in the chamber oriented in a direction to push the first and second portions of the sheet away from each other and thereby expand the volume of the chamber.

22. The method of claim 20 and further comprising the steps of:

deployment by unfolding the passageway, placing the head-covering cap portion over the head, with a transparent face-covering portion in front of the face, inserting the mouthpiece into the mouth, with the chamber hanging below the face, and breathing from and to the chamber through the mouthpiece.

23. An emergency exit respiratory device comprising:

a unitary member including a rebreathing bag, a face mask, and a head-mount, all formed of a single sheet of flexible material folded upon itself to place one portion of said material overlying another portion of said material in at least one area of said material, the overlying portion being sealed to the overlaid portion along a first set of selected lines to define boundaries of the rebreathing bag and to define an elongate tube communicating with the bag; and cuts through the member at predetermined locations to define lines along which said tube is separable from said bag while maintaining communication with the bag at one proximal end of the tube.

24. The device of claim 23 and further comprising:

a cut through the member intersecting said cuts at a location remote from said proximal end to define a distal end of the tube open to atmosphere.

25. The device of claim 24 and further comprising:

a compression spring in the bag and oriented to facilitate expansion of the bag to aid inflation thereof.

26. The device of claim 23 and further comprising:

an instruction sheet in the bag and bearing printed instructions on it visible through the bag.

27. The device of claim 26 wherein:

said instruction sheet has luminous indicia thereon visible through the bag material.

* * * * *